United States Patent [19]

Suga

[11] Patent Number: 4,571,927

[45] Date of Patent: Feb. 25, 1986

[54] PACKING APPARATUS

[75] Inventor: Tadoru Suga, Ibaraki, Japan

[73] Assignee: Ibaraki Seiki Co., Ltd., Osaka, Japan

[21] Appl. No.: 572,747

[22] Filed: Jan. 23, 1984

[51] Int. Cl.[4] ..... B65B 9/10; B65B 49/14

[52] U.S. Cl. ..... 53/547; 53/206; 53/209; 53/556

[58] Field of Search ..... 53/206, 209, 210, 547, 53/550, 556

[56] References Cited

U.S. PATENT DOCUMENTS 3,973,372 8/1976 Omori ..... 53/222 X 4,483,125 11/1984 Suga ..... 53/547

FOREIGN PATENT DOCUMENTS 2073696 10/1981 United Kingdom ..... 53/556

*Primary Examiner*—John Sipos

*Attorney, Agent, or Firm*—Stevens, Davis, Miller & Mosher

[57] ABSTRACT

A packing apparatus by which trays containing articles are wrapped by a film of flexibility and extensibility, the film wrapping the trays in a tubular shape being cut between the successive trays, so that the leading end of the cut tubular film is taken in a first air suction channel and held therein and then folded toward the bottom surface of each tray and the trailing end of the film is taken in a second air suction channel and held therein and then folded by a roller mechanism having an opening toward the bottom surface of the same.

14 Claims, 14 Drawing Figures

PACKING APPARATUS

FIELD OF THE INVENTION

This invention relates to a packing apparatus for packing by a plastic film articles together with trays containing them, and more particularly to a packing apparatus which makes tubular a thermoplastic film well extensible and supplies a number of trays containing articles into the tubular film so that the tubular film is cut between the respective trays and extended and folded toward the bottom surface of each tray.

The packing apparatus of the invention, as shown in FIGS. 12 through 14, aims at mass-producing articles 1 contained in a tray 2 and wrapped by a tubular film 3, the film 3 at first extending from both lengthwise ends of tray 2 and then being folded at both extended ends toward the bottom surface of tray 2 and deposited thereon. In this case, the film is previously expanded to be free from wrinkles, whereby the articles are made presentable through the transparent film.

BACKGROUND OF THE INVENTION

Conventionally, the packing apparatus as fundamental has been proposed in the U.S. Pat. No. 4,144,697 by the inventor of the present invention, which comprises means for making a band of film tubular lengthwise in sequence, and means for feeding articles to the tubular-film-making means at regular intervals, means at the downstream side of the tubular-film-making means and for cutting the film between the respective trays, suction means which uses an air flow to suck downwardly both ends of tubular film at both sides of tray, roller means having an opening in part and for folding the upstream side end of tubular film toward the bottom surface of each tray, and means for folding the downstream side end of the tubular film toward the bottom surface of each tray. In detail, the packing apparatus disclosed in the U.S. Pat. No. 4,144,697 conveys the trays in the tubular film continuously on an air suction channel so that both ends of the tubular film are stretched downwardly by suction applied to both ends and caught by the predetermined hook element to be folded toward the bottom surface of each tray. Such method requires the air suction channel larger in length to lead to a larged-sized apparatus. In order to solve this problem, a method is proposed which conveys the trays intermittently to cut the film during the stop and then both ends of the cut film are taken in the lower air suction channel and folded downwardly simultaneously with starting of transportation of the trays. Such method can reduce the air suction channel in length to miniaturize the apparatus, but the packing capability is small and also the suction by air is insufficient to stretch the film ends. For example, sliced-meat products are mostly reinforced by the trays and a thermoplastic film merely covers the upper opening of tray 2 as shown in FIG. 14 and also is made as thinner as possible from the economical view-point. This kind of film becomes larger in the frictional property as it is extended so that both ends 3*a* and 3*b* of film folded onto the bottom surface of tray are easy to stick naturally thereon even without heating. Some films are extensible even by 300% and the film as thinner as possible is used so that if the film is insufficiently extended to cover the tray, the film is slackened above the tray even with a minute temperature change and hinders the transparency of film, thereby not making the articles presentable.

Therefore, it is required that the trays are continuously transported without lowering the packing capability therefor and also the film is not only pulled by air suction but also mechanically extensible.

SUMMARY OF THE INVENTION

An object of the invention is to provide a packing apparatus which conveys the trays continuously without lowering the packing capability, disposes a pair of air suction channels at the upstream and downstream sides of a film cutting mechanism to thereby take the leading and trailing ends of the cut film in the suction channels, and provides mechanisms for holding both the ends of the cut film within the air suction channels respectively to mechanically extend the film, thereby being small-sized as a whole and mechanically extensible of the film.

This invention is characterized in that the packing apparatus comprises a first air suction channel for turning downwardly the leading end of the tubular film wrapping the articles and cut by the cutting mechansim, a second air suction channel for turning downwardly the trailing end of the same, the first and second air suction channels being disposed at the upstream and downstream sides of cutting mechanism and having air inlets respectivley, first and second film holding mechansim provided in the first and second air suction channels and for holding both the ends of the film taken therein through the air inlets respectively, a side belt mechansim for putting therebetween the trays wrapped by the film and forcibly transporting them across the first and second air suction channels and also folding the leading end of the tubular film toward the bottom surface of each tray, and a roller mechanism of endless belt system which moves faster than the side belt mechanism so that the trailing end of the film held by the second holding mechansim is folded toward the bottom surface of the tray and also has an opening matching with the air inlet of second air suction channel.

In the packing apparatus of the invention, the air suction channels merely take therein the leading and trailing ends of the tray-wrapping film, thereby being small-sized, and the side belt mechanism forcibly transports the trays and the roller mechanism moves faster than the trays while holding both the ends of tubular film by the first and second holding mechanisms, so that both the ends are forcibly folded toward the bottom surface of each tray, the trays are transportable continuously and also the film is sufficiently extensible. Hence, the problem that the film covering the trays displayed in the showcases creates wrinkles to deteriorate its transparency can be solved.

These and other object of the invention will become more apparent in the detailed description and examples which follow.

DETAILED DESCRIPTION OF THE INVENTION

Figure 1:
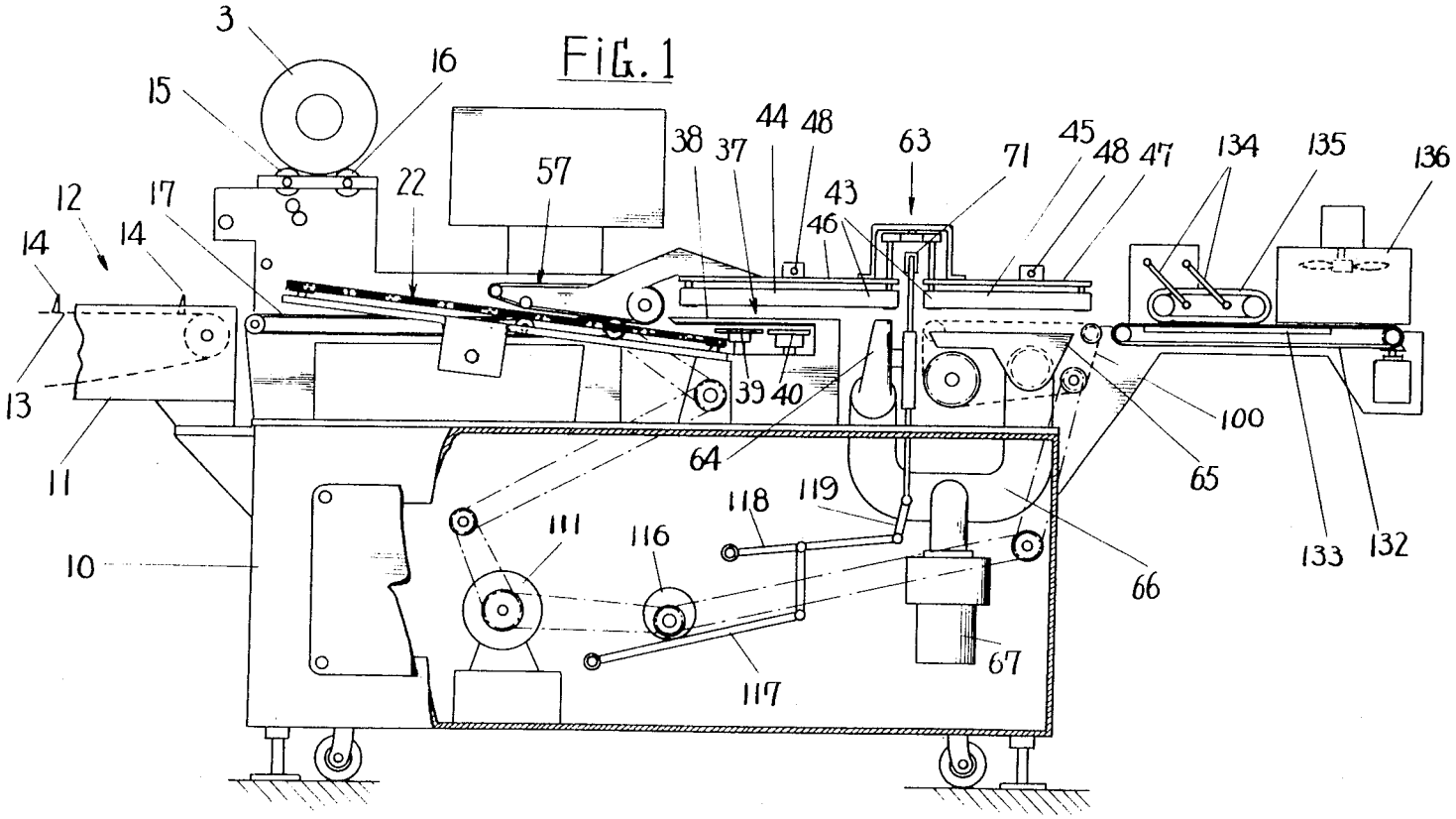
FIG. 1 is a side view of an embodiment of a packing apparatus of the invention.

Referring to FIG. 1, a packing apparatus of the invention comprises a cubic stand 10 and various mechanisms provided thereon. A conveyor 12 for supplying the trays containing articles is provided at a frame 11 connected horizontally to the stand 10 at the left side thereof and comprises an endless chain 13 having attachments 14 mounted thereon at regular intervals, the attachments 14 pushing the trays to be slidably conveyed on the frame 11.

Figure 2:
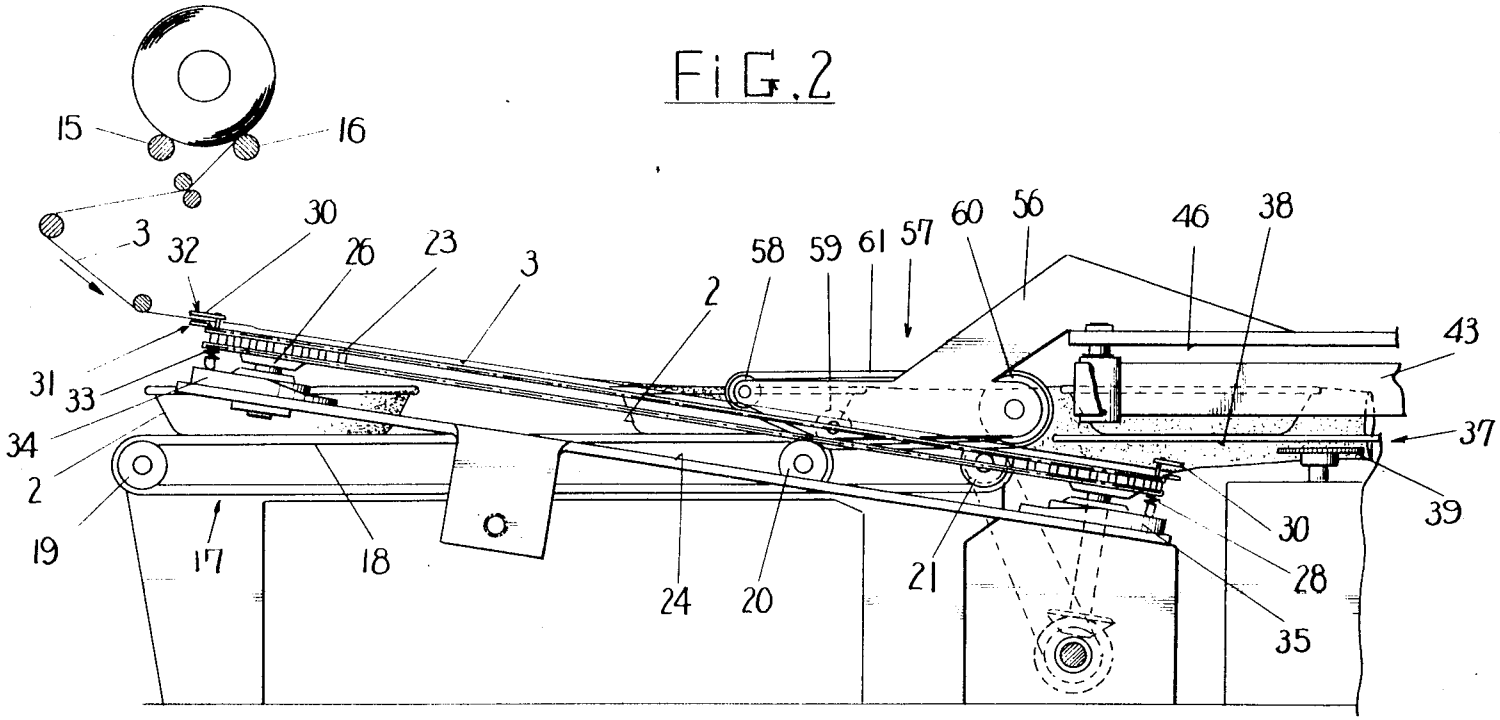
FIG. 2 is an enlarged view of a tubular-film making mechanism in the FIG. 1 embodiment.

The stand 10 supports at the upper portion thereof rollers 15 and 16 carrying a rolled film 3, and below the rollers 15 and 16 and at the upper surface a conveyor 17. The conveyor 17 is positioned on the extension line of the tray feed conveyor 12 and comprises an endless belt 18 supported to the stand 10 through pulleys 19, 20 and 21 as shown in FIG. 2.

Figure 3:
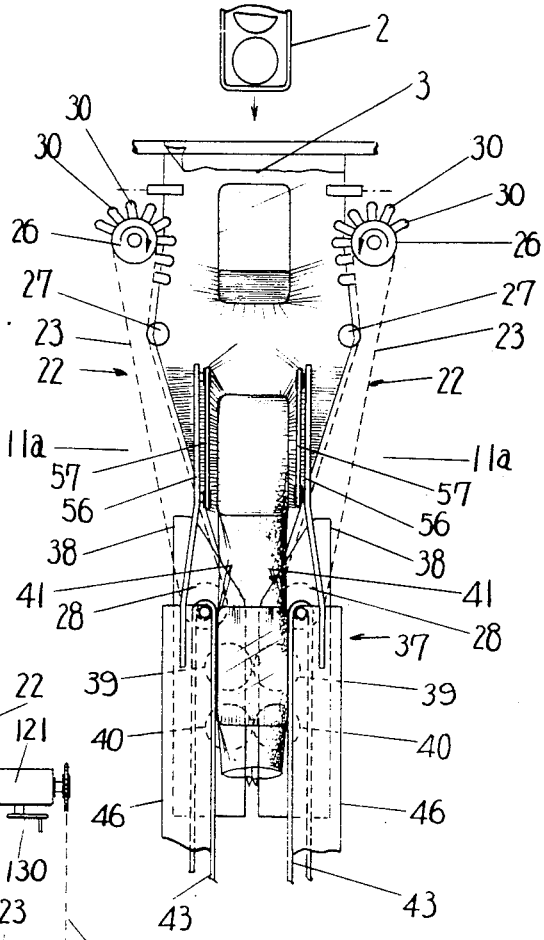
FIG. 3 is a reduced plan view of the tubular-film making mechanism.

A film transport mechanism 22 for transporting the film from above the conveyor 17 horizontally slantwise and downwardly, is provided along both sides of conveyor 17, and comprises a pair of endless chain 23 supported through pairs of chain wheels 26, 27 and 28 to a pair of support plates 24 fixed to both sides of stand 10, the endless chains 23 providing a number of clips 30 spaced at uniform intervals from each other. The chain 23, as shown in FIGS. 2 and 3, are spaced at the upstream sides about equally to a width of film 3, at an intermediated portions larger than that, and at the downstread side narrower than the same through the chain wheels 28 approaching each other. The clips 30, as shown in FIG. 2, each comprise a fixed segment 31 and a movable segment 32 which are mounted to the chain 23, each clip 30 being adapted to be closed by a spring 33 and open by a cam 34 or 35.

A tubular-film making mechanism 37 for stretching transversely the film and wrapping it around the trays 2 in a tubular form is provided in continuation of conveyor 17. The tubular-film making mechanism 37, as shown in FIG. 3, comprises a pair of throttle plates 38 and pairs of rollers 39 and 40 positioned thereunder, the throttle plates 38 being juxtaposed and opposite at inner edges 41 to each other in a V-like shape and overlapping in part with the rear ends of film conveyors 22 respectively.

Figure 4:
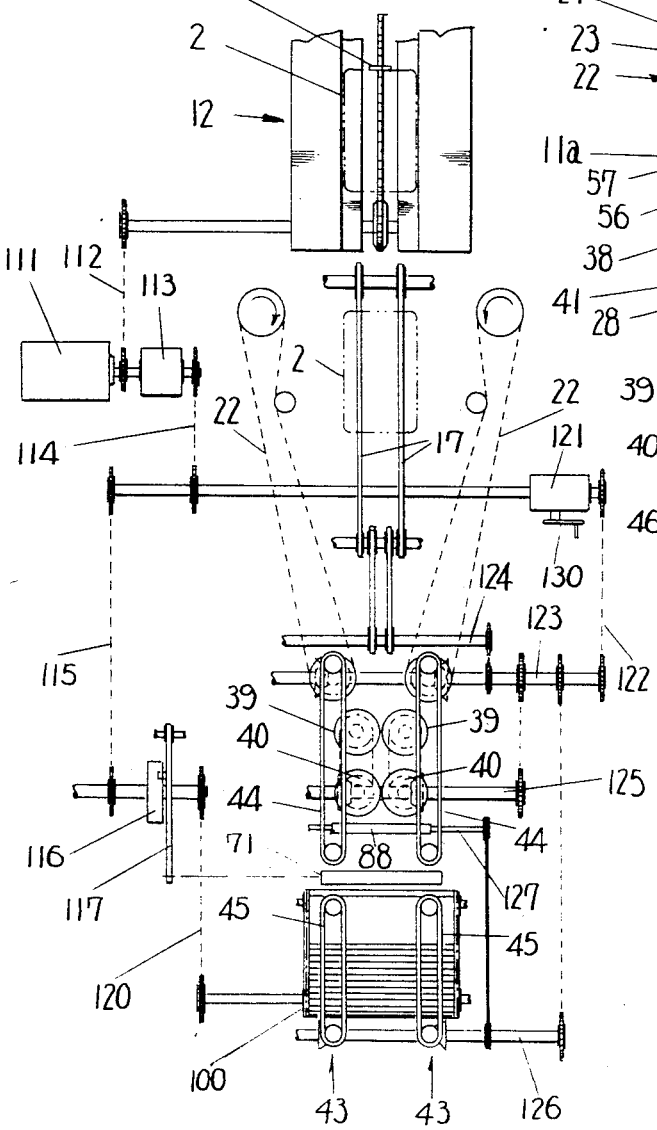
FIG. 4 is a plan view explanatory of power transmission in this embodiment.

Further, a side belt mechanism 43 extends from above the tubular-film making mechanism 37 toward the downstream side thereof and in a manner of sandwiching the trays 2, and comprises, as shown in FIG. 4, a pair of endless belts 44 juxtaposed at the upstream side and a pair of endless belts 45 juxtaposed at the downstream side. Between the side belts 44 and those 45 is provided a cutting mechanism 63 to be discussed below. The four side belts 44 and 45, as shown in FIG. 1, are rotatably mounted through pulleys to frames 46 and 47 which are provided above the belts 44 and 45 and fixed to the stand 10 through rods 48 extending transversely respectively. The frames 46 at the upstream side and those 47 at the downstream side, as enlarged in FIG. 7, are connected by a gate member 49, and gears 51 coaxial with pulleys 50 at the upstream side and gears 53 coaxial with pulleys 52 at the downstream side, are connected through idler gears 54 pivoted to the connecting member 49 respectively, thereby transmitting a driving force to each belt 44 or 45 relative to each other.

Figure 11:
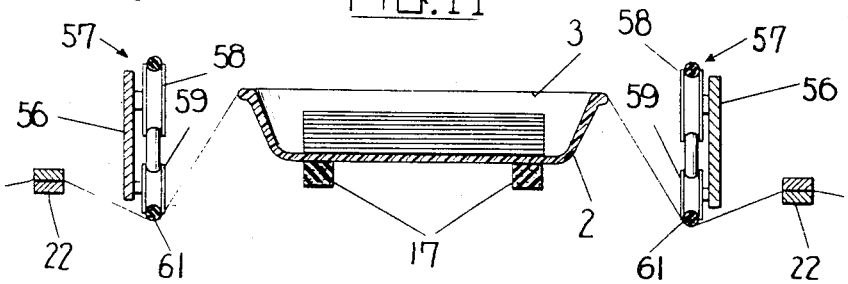
FIG. 11 is a sectional view taken on the line 11*a*—11*a* in FIG. 3, and FIGS. 12 through 14 are illustrations of packed articles.

Referring to FIG. 3, arms 56 project from the frames 46 at the side belt mechanism 43 toward the inside of film transport mechanism 22 and provide film stretching belt mechanisms 57 respectively. The film stretching belt mechanisms 57, as shown in FIGS. 2 and 11, comprise round belts 61 supported rotatably to the arms 56 through grooved pulleys 58, 59 and 60 respectively, the round belts 61 functioning to urge the film downwardly at both sides of each tray 2 transported by the conveyor 17.

The film cutting mechanism 63, as shown in FIG. 1, is provided at an intermediate portion of side belt mechanism 43 and a first air suction channel 64 is provided at the upstream side of cutting mechanism 63 and a second air suction channel 65 at the downstream side of the same, the air suction channels 64 and 65 forming air inlets orienting upwardly, and connecting at the lower ends through a duct 66 with a vacuum pump 69 provided wtihin the stand 10 so that air is always taken into the channels 64 and 65 through the air inlets.

Figure 5:
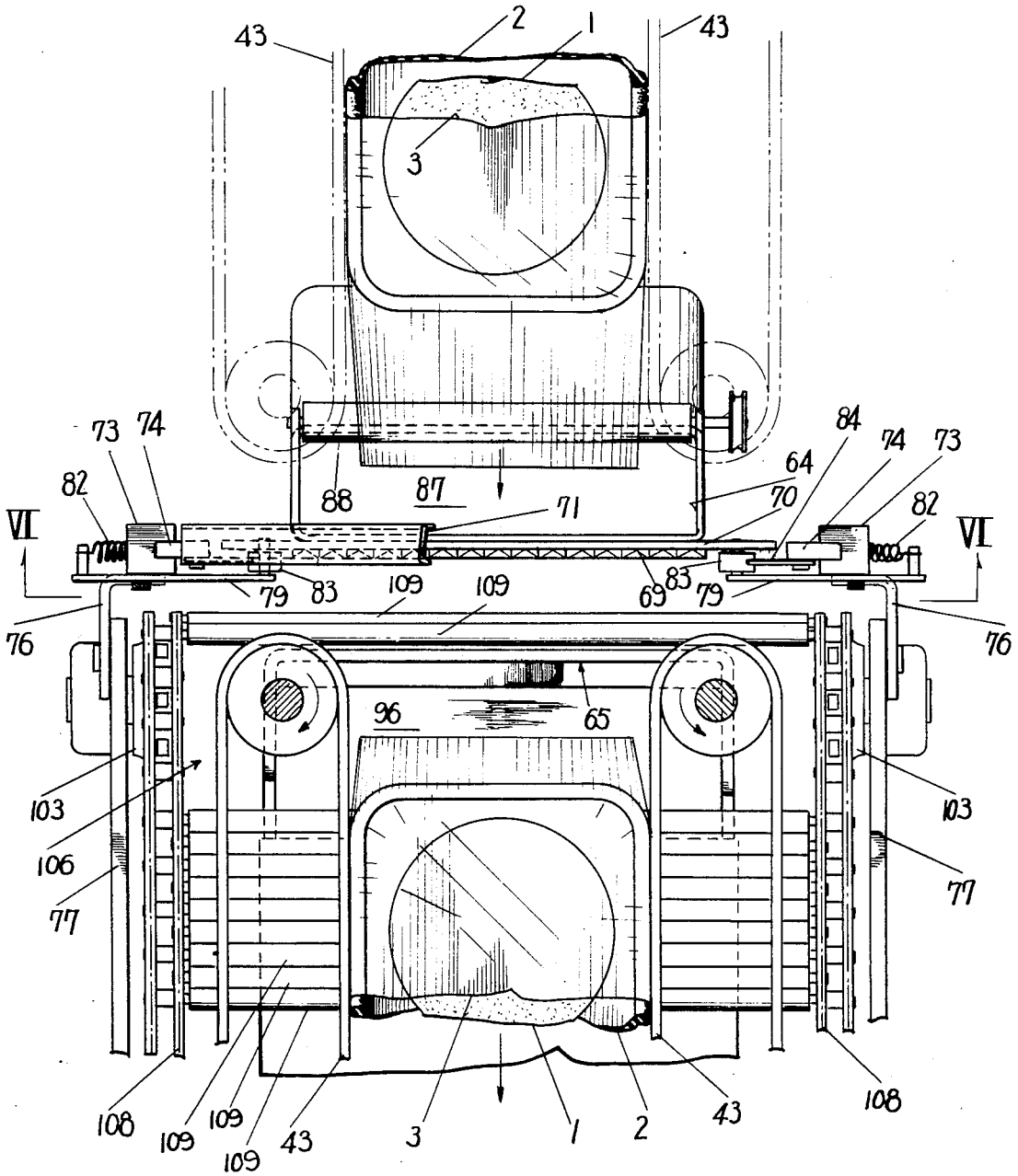
FIG. 5 is a plan view of a portion including a cutting mechansim.
Figure 6:
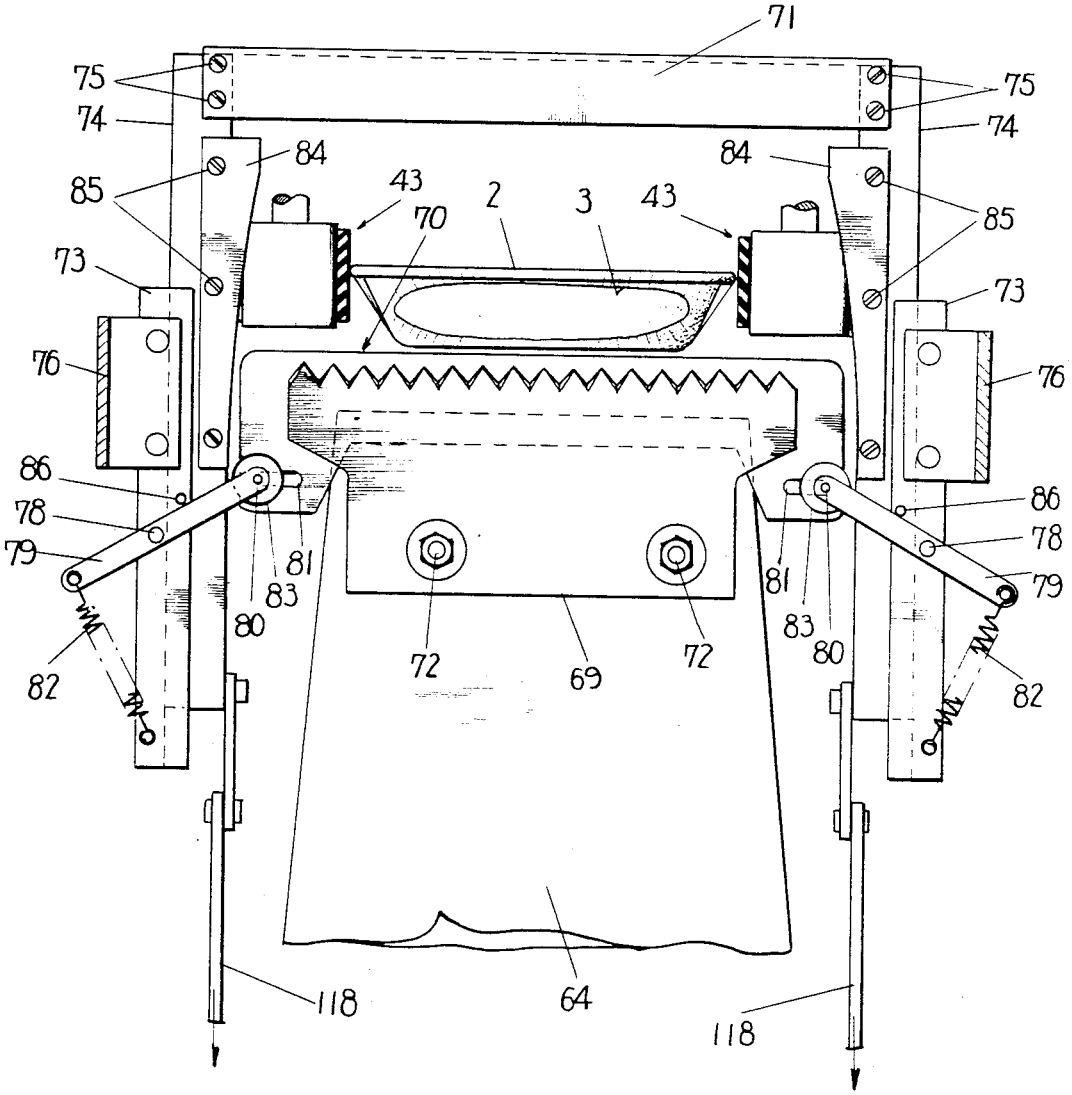
FIG. 6 shows the cutting mechanism when viewed on the line VI—VI in FIG. 5.
Figure 7:
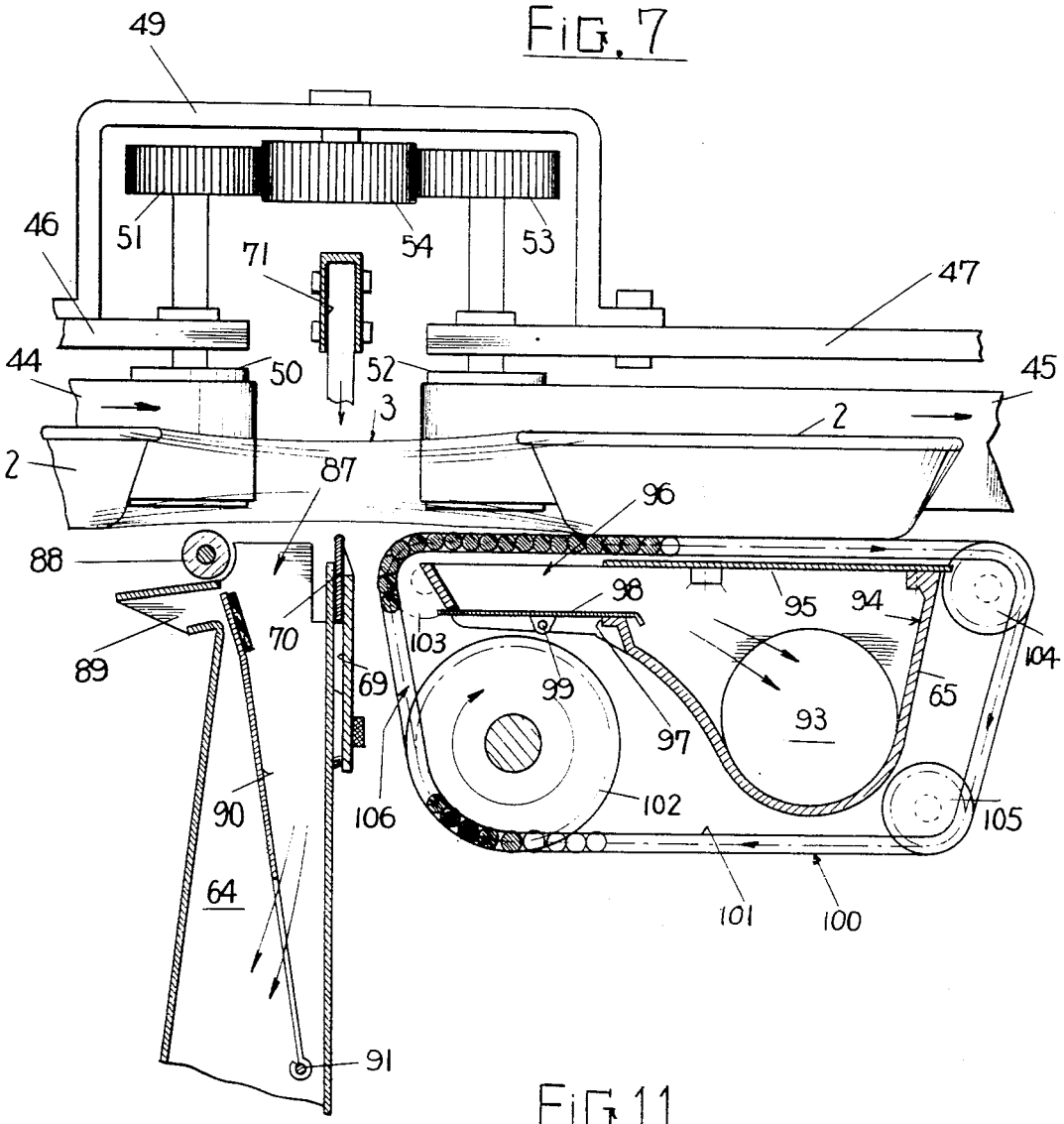
FIG. 7 is a partially sectional side view of the cutting mechanism and the vicinity thereof.

The film cutting mechanism 63, as shown in FIG. 7, comprises a blade 69, a film-resistance giving plate 70, and an upper cutting element 71 grooved downwardly and provided above and opposite to the blade 69, the blade 69, as shown in FIGS. 5 and 6, being fixed to the first air suction channel 64 through screws 72 and having a saw-tooth-edge directed upwardly, the film-resistance giving plate 70 being sandwiched vertically movably between the blade 69 and the wall of first air suction channel 64. At both lengthwise sides of blade 69 are provided vertically pole guides 73 of groove-shape in section and lifting levers 74 are inserted slidably into the grooves of guides 73 so that the upper cutting element 71 is fixed across the upper ends of lifting levers 74 by use of screws 75. The pole guides 73 are mounted through segments 76 to frames 77 for a roller mechanism 100 at the downstream side respectively. Below the segments 76, levers 79 are supported rotatably to the pole guides 73 through pins 78 respectively, pins 80 fixed to the inner ends of levers 79 engage with slits 81 respectively, and tension springs 82 are provided between the outer ends of levers 79 and the pole guides 73 so that the film-resistance giving plate 70 is biased by the springs 82 to project at the upper end upwardly from the edge of blade 69. Pulleys 83 are supported rotatably to the pins 80 at the levers 79 and cam plates 84 are fixed to the both side lifting levers 74 by screws 85 in such a manner that the opposite faces of cam plates 84 slope upwardly to make smaller a distance therebetween, the levers 79 abutting against stoppers 86 to thereby define the upper limit of upward movement of film-resistance giving plate 70.

Figure 8:
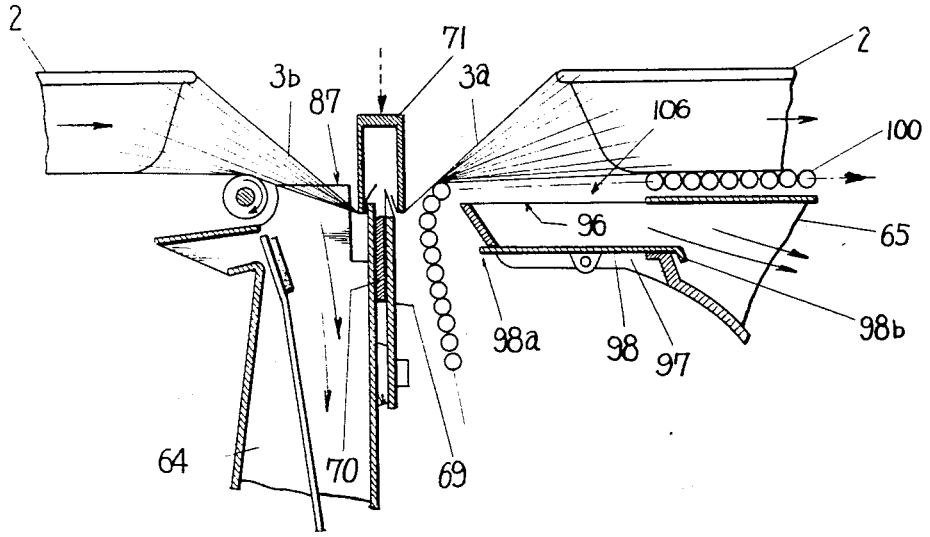
FIGS. 8 through 10 are views explanatory of operations of the principal portion in FIG. 7.
Figure 9:
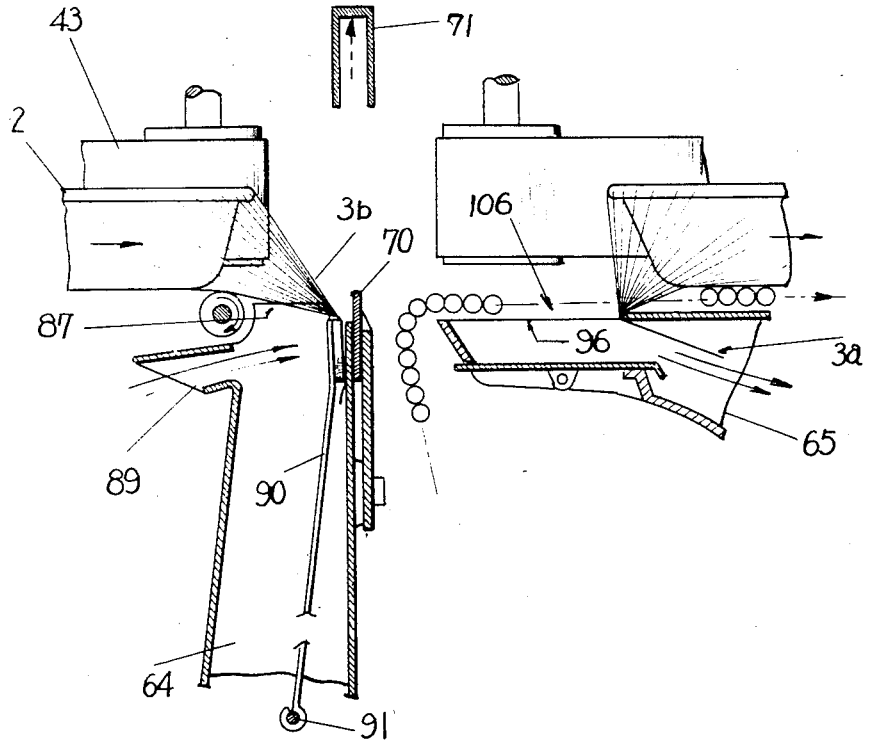
Figure 10:
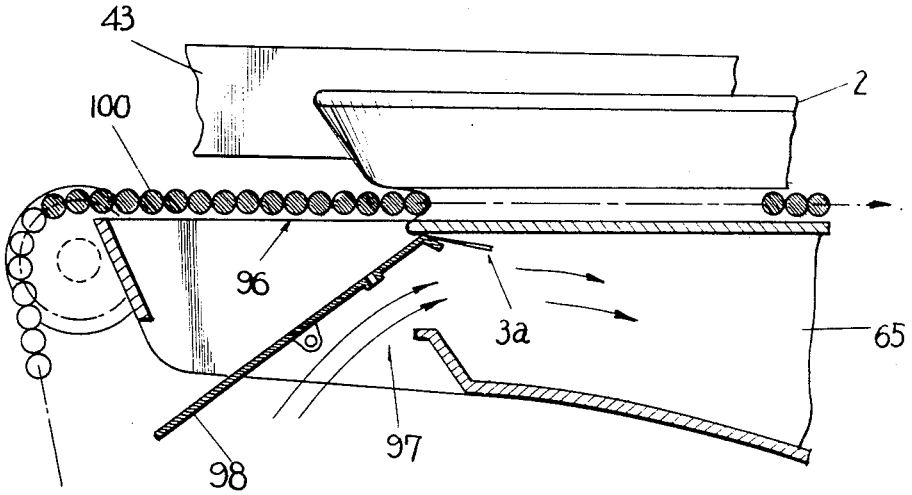
Figure 12:
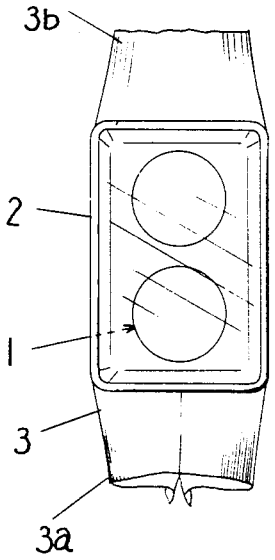
Figure 13:
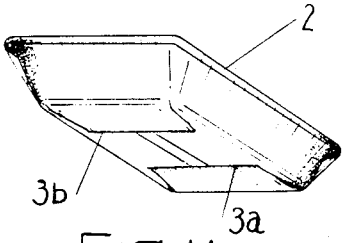
Figure 14:
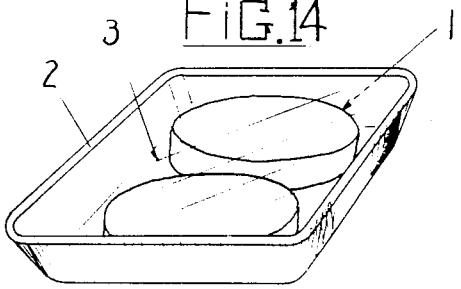

Referring again to FIG. 7, an air inlet 87 is provided at the upper end of first air suction channel 64 and a roller 88 is provided at the edge of air inlet 87 at a side of the front wall of channel 64, the roller 88 rotating at the peripheral speed faster than the transportation speed of each tray 2 and functioning to positively guide in the air inlet 87 the leading end of the cut tubular film wrapping the tray 2. A first bypass port 89 is formed at the front wall of first air sunction channel 64, positioned below the roller 88, and directed toward the rear wall of the same. Also, a first damper 90 is provided within the first air suction channel 64, extends substantially lengthwise thereof, is pivoted at the lower end swingably to the side wall of channel 64, and is opposite at the upper end to a mouth of bypass port 89. The first swingable damper 90 has the centroid deviated toward the front wall of channel 64, whereby the damper 90 normally leans to close by the upper end thereof the mouth of bypass port 89 from inside of channel 64. On the other hand, the second air suction channel 65 at the downstream side of cutting mechanism 63 comprises a bowl 94 having at the side wall a port 93 communicating with the vacuum pump 67 and a lid 95 mostly fixed to the upper end of bowl 94 and having in part an air inlet 96. A second bypass port 97 is open at the bottom of bowl 94 and just below the air inlet 96, and a second damper 98 is provided at the second bypass port 97, supported at an intermediate portion rotatably to a horizontal pin 99, and adapted to be balanced to close the bypass port 97, in which the front end 98*a* of second damper 98 is positioned below the edge of second bypass port 97 and the rear end 98*b* of damper 98 above the same. In addition, operations of first and second dampers 90 and 98 are shown in FIGS. 8 through 10.

A roller mechanism 100 of an endless belt 101 surrounds the second air suction channel 65 as shown in FIG. 7. The belt 101 is supported to rollers 102, 103, 104, and 105 in relation of being rotatable around the second air suction channel 65; has an opening 106 at only one position so that when the air inlet 96 matches with the opening 106, the trailing end of the cut tubular film is adapted to be sucked downwardly; and comprises a pair of endless chains 108 at both sides and a number of rod-like rollers 109 proivded across the chains 108 at both sides, the rollers 109 scarcely having gaps therebetween except for the aforesaid opening 106.

FIG. 4 shows a construction for transmitting a driving force from an electric motor to the respective mechanisms, in which the electric motor 111 having reduction gears and the supply conveyor 12 are connected through a chain 112 so that the tray-feed conveyor 12 rotates continuously at constant speed, the motor 111 connecting with a chain 114 through an electromagnetic clutch means 113 which disengages for stopping each mechanism at need, but normally engages to transmit the driving force. The driving force is transmitted in part through the clutch means 113 to a rotary grooved cam 116 through chains 114 and 115 and a lever 117 engageable with the grooved cam 116 swings to move vertically the upper cutting element 71 at the cutting mechanism 63. The motor 111, grooved cam 116 and lever 117, are contained in the stand 10 as shown in FIG. 1, so that the lever 117 transmit its swinging motion to the upper cutting element 71 through the upper levers 118 and links 119. Further, the driving force for the cam 116 is transmitted also to the roller mechanism 100 through a chain 120, the driving force output from the electromagnetic clutch 113 is transmitted in part to a chain 122 through a variable speed gear 121, and the driving force from the chain 122 is transmitted to five shafts 123, 124, 125, 126 and 127, thereby rotating the film transport mechanisms 22, belt conveyor 17, rollers 39 and 40, side belt mechanism 43, and roller 88. In addition, the variable speed gear 121 can change its output to desirably adjust the speed of each mechanism. On the other hand, the driving force transmitted from the clutch 113 through the chain 115 actuates the upper cutting element 71 of cutting mechanism 63 and the roller mechanism 100 at relatively high speed in a speed-up gear ratio.

Next, explanation will be given on operation of the aforesaid embodiment.

Referring to FIG. 3, a number of clips 30 provided at the chains 23 are actuated by cams 34 at both turning points of the chains 23 rotating in the direction of the arrow. When each clip 30 is actuated by each cam 34 as shown in FIG. 2, the movable segment 32 moves away from the fixed segment 31 against the spring 33 to open each clip 30 so that the film 3, when guided to the position where each clip 30 is temporarily open, is guided and then clipped by the clips 30 in sequence with each other as the chains 23 rotate, thereby being transported in the direction of the arrow and simultaneously stretched laterally.

The conveyor 12, as shown in FIG. 1, pushed the trays 2 by the attachments 14 and continuously feeds the trays 2 onto the conveyor 17 at the dowhstream side, the trays 2 being fed therewith under the film 3. Since each chain 23 inclines downwardly and a chain wheel 28 at the downstream side is positioned lower than the upper surface of belt 18 at the conveyor 17, each tray 2 creeps below the film 3 in a manner of pushing up the film 3. A pair of film stretching belts 57 are provided at both sides of the tray transport path so that the trays 2 travel between the belts 57 as shown in FIG. 11. The round belts 61, which are supported rotatably by the plural pulleys, rotate integrally with the moving film 3 and turn both side edges of film 3 downwardly at both sides of tray 2. Since the film transportation mechanisms 22 gradually approach each other and are intended to wrap each tray 2 by the film 3, the film 3 once stretched begins to slack, but the film stretching belts 57 press the film 3 downwardly to prevent the slackness thereof.

As seen from FIG. 3, both the widthwise ends of film 3 lower than each tray 2 are forcibly brought into between the throttle plates 38 and stretched thereby. At this position, the film transport mechanisms 22 terminate so that the clips 30, as shown in FIG. 2, ride on the cam 35 at the rear turning point of each chain 23, thereby being automatically open to release both side edges of film 3. Both the side edges of film 3 released as abovementioned are sandwiched by the rollers 39 so as to be put together with each other and then deposited by rollers 40 at the downstream side. As a result, the film 3 becomes tubular around the trays 2 and contains them at regular intervals, the trays 2 wrapped by the tubular film 3 entering between the side belts 43 and being transported therewith.

When the tubular film 3 is positioned at an intermediate portion between two trays 2 and just below the upper cutting element 71 as shown in FIG. 7, the element 71 lowers to cut the tubular film 3. As seen from FIG. 4, the upper cutting element 71 and conveyor 12 having the attachments 14 are operated by the same power system to be always in synchronism with each other, whereby the upper cutting element 71 lowers at the intermediate portion between two trays 2 in synchronism with movement of attachments 14 on the conveyor 12. Referring to FIG. 1, the grooved cam 116 continuously rotates to act on each lever 118, thereby vertically moving the upper cutting element 71 at the predetermined cycle period, which will be more detailed in accordance with FIG. 6. Namely, both the levers 118 are actuated to lower the lifting rods 74 along the pole guides 73, then the cam plates 84 urge the film-resistance-giving plate 70 downwardly through the pulleys 83, whereby the film-resistance-giving plate 70 lowers together with the upper cutting element 71 and is positioned lower than the edge of blade 69. Hence, the edge of blade 69 projects alone and the upper cutting element 71 lowers to cover the blade 69, thereby cutting the tubular film 3. As a result, the leading end **3*b* and trailing end 3*a* of tubular film 3 are formed between the adjacent trays 2 as shown in FIG. 8, the leading and trailing ends 3*b* and 3*a* being subjected to suction from the first and second air suction channels 64 and 65 respectively. When the leading end 3*b* of the cut tubular film 3 is taken into the first air suction channel 64, the air inlet 87 thereof is in the state of being closed by the leading end 3*b* to thereby deteriorate suction of air into the first air suction channel 64 as shown in FIG. 8. Consequently, a new air flow, as shown in FIG. 9, is created in the first bypass port 89 to push the first damper 90 toward the rear wall of channel 64 so that the damper 90 presses the leading end 3*b* of film 3 onto the rear wall. Next, in FIG. 6, when the upper cutting element 71 is pushed upwardly by both side levers 118 and the film-resistance-giving plate 70 is released, the springs 82 contract to raise the plate 70 higher than the blade edge 69 as shown in FIG. 9. When. each tray 2, after the tubular film 3 is cut, passes above the film-resistance-giving plate 70 under the driving force of side belt mechanism 43, the leading end 3*b* of film 3 is subjected to frictional resistance from film-resistance-giving plate 70 and increases the frictional resistance in a manner of twining round the plate 70 because the leading end 3*b* is caught by the first damper 90, thereby being extended lengthwise and folded toward the bottom surface of each tray 2. Then, the air inlet 87 is open after the tray 2 passes above the first air suction channel 64 and the first damper 90 swings to restore to the original position by virture of its centroid one-sided toward the bypass port 89. On the other hand, the trailing end 3*a* of tubular film 3 is taken in the second air suction channel 65 simultaneously with being cut as shown in FIG. 9. In other words, when the air inlet 96, as shown in FIG. 8, matches with the opening 106 at the roller mechanism 100 continuously rotating, the upper cutting element 71 lowers to cut the film 3 at the predetermined timing, whereby the trailing end 3*a* of tubular film 3 is taken in the second air suction channel 65 through the air inlet 96 matching with the opening 106. Just thereafter, when the air inlet 96 is closed by the roller mechanism 100 in continuous rotation, air is taken in from the second bypass port 97 and flows to turn the second damper 98, whereby the trailing end 3*a* of film 3 is held by the end 98*b* of second damper 98 onto the inner surface of the upper wall of second air suction channel 65. The trailing end 3*a* is folded in a manner of twining round the edge of air inlet 96, and increases the frictional resistance, whereby the power of roller mechanism 100 rotatable at higher speed than transportation of tray 2 extends the film 3 also, lengthwise, thus folding the trailing end 3*a* of tubular film 3 toward the bottom surface of each tray 2. Incidentally, since the air inlet 96 is open through the opening 106 at the roller mechanism 100 and air is taken in from the inlet 96, the second damper 98 restores to the original position. Next, the trays 2, as shown in FIG. 1, are conveyed from the side belt mechanism 43 to a discharging belt coveyor 132. A heater plate 133 is positioned under the belt of conveyor 132 to thereby deposit both the folded ends of film 3 onto part of the tubular film wrapping each tray 2. In this case, since the tray 2 is subjected to weight of a roller 135 supported vertically movably to the stand 10 through parallel links 134, both the folded ends of film 3 are stuck closely to the bottom surface of tray 2. Also, in a case where a hot air tunnel 136 is provided at the downstream side of roller 135 and a shrinkage film is used, the film can be heated and contracted at the hot air tunnel 136, thereby carrying out the shrink wrapping. The hot air tunnel 136**, however, is not used when articles, such as perishable foods, to be subjected to an adverse effect by heat are packed.

As seen from the above, the packing apparatus of the invention comprises the tray transport mechanism 22 having the conveyor 12 and film stretching belts 57, film cutting mechanism 63, first and second air section channels 64 and 65 including the first and second dampers 90 and 98, and roll mechanism 100, so that the film 3 wrapping the trays 2 is cut and the leading and trailing ends of tubular film are folded and deposited to the bottom surface of each tray and effectively extensible by use of the dampers and air flow as abovementioned, whereby the packing apparatus is advantageous in that the trays are continuously transported and also can be packed by the film without creating wrinkles.

While a preferred embodiment of the invention has been described using specific terms, such description is for illustrative purpose only, and it is to be understood that changes and variations may be made without departing from the spirit or scope of the following claims.

What is claimed is:

1. An improvement in a packing apparatus for wrapping a flexible and extensible film around trays having articles therein, said apparatus including a conveyor for transporting said trays, a mechanism for supplying to said trays while said trays are being transported by said conveyor a band of said film at a same speed as that of said conveyor and to wrap each of said trays by said film in a tubular shape, a cutting mechanism for cutting said tubular film wrapping each of said trays between successive said trays in a transport direction thereof, and a mechanism for folding downwardly leading and trailing ends of said film cut by said cutting mechanism and for sticking said ends to a bottom surface of corresponding said trays, said improvement comprising:

(a) air suction means comprising a first air suction channel mounted upstream of the cutting mechanism for turning downwardly a said leading end of said film cut by said cutting mechanism and a second air suction channel mounted downstream of the cutting mechanism for turning downwardly a said trailing end of said film cut by said cutting mechanism, said first and second air suction channels being spaced apart a distance such that they are disposed between successive said trays in a transport direction thereof during a cutting operation with respect to said cutting mechanism, said first and second air suction channels each comprising air inlets open upwardly respectively, a first film holding means and a second film holding means being located within said first and second air suction channels respectively for holding therein said leading and trailing ends of said film taken in through said air inlets respectively;

(b) a side-belt mechanism for laterally sandwiching said trays wrapped by said tubular film and for forcibly transporting them so that said trays are allowed to pass through said cutting mechanism and said first and second air suction channels to thereby downwardly fold toward the bottom surface of each of said trays a said leading end of said film held by said first film holding means within said first air suction channel; and (c) a roller mechanism of endless-belt type for moving under said trays at a higher speed than that of said side-belt mechanism to thereby fold downwardly toward the bottom surface of each of said trays a said trailing end of said film held by said second film holding means within said second air suction channel, said roller mechanism providing an opening matching with said air inlet at said second air suction channel, said first air suction channel being provided in the vicinity of its said air inlet with a first bypass port and said first holding means within said first air suction channel comprising a first damper which normally closes said first bypass port and swings to open said first bypass port when said film to be cut by said cutting mechanism closes said air inlet, whereby a said leading end of said film taken in through said air inlet of said first air suction channel is held between said damper and an inner wall of said first air suction channel.

2. A packing apparatus according to claim 1, wherein said cutting mechanism is provided with a cutting blade, a film-resistance-giving plate which is supported to be capable of advancing or retreating with respect to said cutting blade and gives to a leading end portion of said film held by said film holding means resistance against movement of said film caused by said side belt mechanism, and an upper cutting element for pressing said film with respect to said cutting blade and press-cutting said film in cooperation with said cutting blade.

3. A packing apparatus according to claim 2, wherein said cutting blade comprises a blade having a saw-tooth edge and is fixed to a front wall of said first air suction channel in the transport direction of said trays.

4. A packing apparatus according to claim 1, wherein a roller is disposed at an upper portion of said first air suction channel, said roller being rotatable at high speed by said side belt mechanism to feed a said leading end of said film into said first air suction channel.

5. A packing apparatus according to claim 1, wherein said roller mechanism is provided with a belt disposed to surround said second air suction channel.

6. A packing apparatus according to claim 5, wherein said belt comprises a pair of endless chains and a number of rollers provided across both said chains and disposed tightly close to each other, said opening being formed by a lack of some of said rollers.

7. A packing apparatus according to claim 1, wherein said mechanism for wrapping said trays into said tubular film comprises a pair of film conveyors provided with film holding clips for clipping said film at both widthwise sides thereof and supplying to said trays said film laterally slantwise and downwardly, film stretching belt means positioned inside said film conveyors and outside said trays to thereby push down said film, and a tubular-film making mechanism positioned at a downstream side of said film conveyors and in front of each of said trays in the transport direction thereof so that said film released from said clips at said film conveyors is folded at both widthwise sides together with each other and toward the bottom surface of each of said trays, thereby being made tubular.

8. An improvement in a packing apparatus for wrapping a flexible and extensible film around trays having articles therein, said apparatus including a conveyor for transporting said trays, a mechanism for supplying to said trays while said trays are being transported by said conveyor a band of said film at a same speed as that of said conveyor and to wrap each of said trays by said film in a tubular shape, a cutting mechanism for cutting said tubular film wrapping each of said trays between successive said trays in a transport direction thereof, and a mechanism for folding downwardly leading and trailing ends of said film cut by said cutting mechanism and for sticking said ends to a bottom surface of corresponding said trays, said improvement comprising:

(a) air suction means comprising a first air suction channel mounted upstream of the cutting mechanism for turning downwardly a said leading end of said film cut by said cutting mechanism and a second air suction channel mounted downstream of the cutting mechanism for turning downwardly a said trailing end of said film cut by said cutting mechanism, said first and second air suction channels being spaced apart a distance such that they are disposed between successive said trays in a transport direction thereof during a cutting operation with respect to said cutting mechanism, said first and second air suction channels each comprising air inlets open upwardly respectively, a first film holding means and a second film holding means being located within said first and second air suction channels respectively for holding therein said leading and trailing ends of said film taken in through said air inlets respectively;

(b) a side-belt mechanism for laterally sandwiching said trays wrapped by said tubular film and for forcibly transporting them so that said trays are allowed to pass through said cutting mechanism and said first and second air suction channels to thereby downwardly fold toward the bottom surface of each of said trays a said leading end of said film held by said first film holding means within said first air suction channel; and (c) a roller mechanism of endless-belt type for moving under said trays at a higher speed that that of said side-belt mechanism to thereby fold downwardly toward the bottom surface of each of said trays a said trailing end of said film held by said second film holding means within said second air suction channel, said roller mechanism providing an opening matching with said air inlet at said second air suction channel, said air suction channel being provided in the vicinity of its said air inlet with a bypass port, and said second holding means comprising a second damper which is provided in said air suction channel and normally closes said second bypass port and opens said port by suction when said air inlet is closed by said roller mechanism, so that a said trailing end of said film taken in through said air inlet of said air suction channel is held between said second damper and an inner wall of said second air channel.

9. A packing apparatus according to claim 8, wherein said cutting mechanism is provided with a cutting blade, a film-resistance-giving plate which is supported to be capable of advancing or retreating with respect to said cutting blade and gives to a leading end portion of said film held by said film holding means resistance against movement of said film causes by said side belt mechanism, and an upper cutting element for pressing said film with respect to said cutting blade and press-cutting said film in cooperation with said cutting blade.

10. A packing apparatus according to claim 9, wherein said cutting blade comprises a blade having a saw-tooth edge and is fixed to a front wall of said first air suction channel in the transport direction of said trays.

11. A packing apparatus according to claim 8, wherein a roller is disposed at an upper portion of said first air suction channel, said roller being rotatable at high speed by said side belt mechanism to feed a said leading end of said film into said first air suction channel.

12. A packing apparatus according to claim 8, wherein said roller mechanism is provided with a belt disposed to surround said second air suction channel.

13. A packing apparatus according to claim 12, wherein said belt comprises a pair of endless chains and a number of rollers provided across both said chains and disposed tightly close to each other, said opening being formed by a lack of some of said rollers.

14. A packing apparatus according to claim 8, wherein said mechanism for wrapping said trays into said tubular film comprises a pair of film conveyors provided with film holding clips for clipping said film at both widthwise sides thereof and supplying to said trays said film laterally slantwise and downwardly, film stretching belt means positioned inside said film conveyors and outside said trays to thereby push down said film, and a tubular film-making mechanism positioned at a downstream side of said film conveyors and in front of each of said trays in the transport direction thereof so that said film released from said clips at said film conveyors is folded at both widthwise sides together with each other and toward the bottom surface of each of said trays, thereby being made tubular.

* * * * *